US009803914B2

(12) United States Patent
Anselmino et al.

(10) Patent No.: US 9,803,914 B2
(45) Date of Patent: Oct. 31, 2017

(54) BEVERAGE DISPENSING SYSTEM WITH MACHINE VISION

(71) Applicant: WHIRLPOOL CORPORATION, Benton Harbor, MI (US)

(72) Inventors: Philip A. Anselmino, Saint Joseph, MI (US); Kevin M. Chase, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/082,595

(22) Filed: Mar. 28, 2016

(65) Prior Publication Data

US 2016/0209106 A1 Jul. 21, 2016

Related U.S. Application Data

(63) Continuation of application No. 12/915,139, filed on Oct. 29, 2010, now Pat. No. 9,297,577.

(51) Int. Cl.

| | |
|---|---|
| ***F25B 49/00*** | (2006.01) |
| ***F25D 23/12*** | (2006.01) |
| ***F25D 29/00*** | (2006.01) |

(52) U.S. Cl.

CPC ..... *F25D 23/126* (2013.01); *F25D 29/00* (2013.01); *F25D 2700/04* (2013.01); *F25D 2700/06* (2013.01); *F25D 2700/08* (2013.01)

(58) Field of Classification Search

CPC ..... F25D 2700/06; F25D 2700/04

See application file for complete search history.

(56) References Cited

U.S. PATENT DOCUMENTS

| | | | | |
|---|---|---|---|---|
| 5,190,083 | A | 3/1993 | Gupta et al. | |
| 2003/0071806 | A1 | 4/2003 | Annand | |
| 2004/0035123 | A1 | 2/2004 | Kim et al. | |
| 2005/0178144 | A1 | 8/2005 | Crisp, III | |
| 2005/0196046 | A1 | 9/2005 | Hudnut et al. | |
| 2006/0256132 | A1* | 11/2006 | Shin | F25D 29/00 345/619 |
| 2008/0264092 | A1 | 10/2008 | Chase et al. | |
| 2009/0040012 | A1 | 2/2009 | Ebrom et al. | |
| 2009/0040013 | A1 | 2/2009 | Ebrom et al. | |
| 2009/0040066 | A1 | 2/2009 | Ebrom et al. | |
| 2009/0040067 | A1 | 2/2009 | McCoy et al. | |
| 2009/0044129 | A1 | 2/2009 | Ebrom et al. | |
| 2009/0044137 | A1 | 2/2009 | Bartley et al. | |

(Continued)

FOREIGN PATENT DOCUMENTS

WO WO2005111955 A1 11/2005

OTHER PUBLICATIONS

Cummings et al.; "Barcoding to Enhance Safety"; available Dec. 2005; retrieved on Mar. 2015 from http://psqh.com/sepoct05/barcodingrfid1.html.

*Primary Examiner* — Orlando E Aviles Bosques
(74) *Attorney, Agent, or Firm* — Nyemaster Goode, P.C.

(57) ABSTRACT

A refrigerator is provided which includes a cabinet. A first compartment and second compartment are disposed within the cabinet. A first door provides access to the first compartment and a second door provides access to the second compartment. A beverage dispensing system is operatively connected to the cabinet. A machine vision system associated with the beverage dispensing system. The machine vision system has an imaging device.

19 Claims, 3 Drawing Sheets

(56) References Cited

U.S. PATENT DOCUMENTS

| | | | |
|---|---|---|---|
| 2009/0045926 | A1 | 2/2009 | Ebrom et al. |
| 2009/0046715 | A1 | 2/2009 | McCoy |
| 2010/0187219 | A1 | 7/2010 | Besore et al. |
| 2011/0023511 | A1 | 2/2011 | Lee et al. |

* cited by examiner

BEVERAGE DISPENSING SYSTEM WITH MACHINE VISION

CROSS-REFERENCE TO RELATED APPLICATIONS

This application is a continuation of U.S. patent application Ser. No. 12/915,139, filed on Oct. 29, 2010, entitled "BEVERAGE DISPENSING SYSTEM WITH MACHINE VISION," the disclosure of which is hereby incorporated herein by reference in its entirety.

FIELD OF THE INVENTION

The present invention relates to beverage dispensing. More specifically, but not exclusively, the present invention relates to a beverage dispensing system having machine vision for use in adjusting or controlling beverage dispensing parameters.

BACKGROUND OF THE INVENTION

Consumers that desire a certain beverage are required to purchase, store, retrieve, or prepare the beverage to meet their taste. For example, pre-packaged beverages (such as beverages packaged in cans or bottles) may create storage space issues and issues with transportation. Where beverages are prepared by the consumer, there is the attendant inconvenience of preparing the beverage. In recent years, consumers are turning to single serve pods/cartridges to deliver their hot or even cold beverages through countertop or water cooler based systems. These pods typically may contain a powder, concentrate, or grounds that mix with a fluid to create the beverage. There are examples of current countertop systems that detect the type of pod and configure the system accordingly. However, the use of such systems may limit the ability of a consumer to prepare beverages which match their taste. Even where such systems allow a consumer to adjust parameters affecting taste, doing so may be inconvenient and where multiple users are using the same beverage dispensing system may require each user to modify settings before each use. What is needed is a beverage dispensing system which assists users in preparing beverages according to their individual tastes in a way that is convenient to the users.

BRIEF SUMMARY OF THE INVENTION

Therefore, it is a primary object, feature, or advantage of the present invention to improve over the state of the art.

It is another object, feature, or advantage of the present invention to provide a beverage dispensing system which is convenient to use.

Another object, feature, or advantage of the present invention is to provide a beverage dispensing system which provides customized settings to match specific consumer needs.

Yet another object, feature, or advantage of the present invention is to provide for tracking beverage usage.

A still further object, feature, or advantage of the present invention is to provide for associating users with their user preferences.

Another object, feature, or advantage of the present invention is to provide for recognizing users.

Yet another object, feature, or advantage of the present invention is to provide for recognizing containers.

A still further object, feature, or advantage of the present invention is to provide for predicting beverage settings based on user, container, time, or other information.

Another object, feature, or advantage of the present invention is to provide for associating restrictions on beverage dispensement based on the user or other parameters.

One or more of these and/or other objects, features, or advantages of the present invention will become apparent from the specification and claims that follow. No single embodiment need exhibit all of these objects, features, or advantages. The present invention is not to be limited to or by these objects, features, or advantages.

According to one aspect of the present invention, a refrigerator is provided. The refrigerator includes a refrigerator cabinet, a fresh food compartment disposed within the refrigerator cabinet, a freezer compartment disposed within the refrigerator cabinet, and a beverage dispensing system operatively connected to the refrigerator cabinet and configured to dispense beverages. The refrigerator also includes an imaging device associated with the beverage dispensing system and an intelligent control associated with the beverage dispensing system and operatively connected to the imaging device. The intelligent control may be configured to determine an identity of a user of the beverage dispensing system based upon image information acquired with the imaging device. The beverage dispensing system may be configured to adjust beverage parameters based on the identity of the user.

According to another aspect of the present invention a method of dispensing a beverage is provided. The method includes providing a refrigerator having a refrigerator cabinet, a fresh food compartment disposed within the refrigerator cabinet, a freezer compartment disposed within the refrigerator cabinet, a beverage dispensing system operatively connected to the refrigerator cabinet and configured to dispense beverages, an imaging device associated with the beverage dispensing system, and an intelligent control associated with the beverage dispensing system and operatively connected to the imaging device. The method further includes acquiring image information using the imaging device and determining a beverage dispensing system setting using the image information. The image information may include image information associated with a person and/or image information associated with a container.

According to another aspect of the present invention, a method of dispensing a beverage is provided. The method includes providing a refrigerator having a refrigerator cabinet, a fresh food compartment disposed within the refrigerator cabinet, a freezer compartment disposed within the refrigerator cabinet, a beverage dispensing system operatively connected to the refrigerator cabinet and configured to dispense beverages, a sensing device associated with the beverage dispensing system, and an intelligent control associated with the beverage dispensing system and operatively connected to the sensing device. The method further includes acquiring container information using the sensing device and determining a beverage dispensing system setting using the container information. The sensing device may be an imaging device or may be an RFID reader or other type of device.

DETAILED DESCRIPTION OF THE PREFERRED EMBODIMENTS

Figure 1:
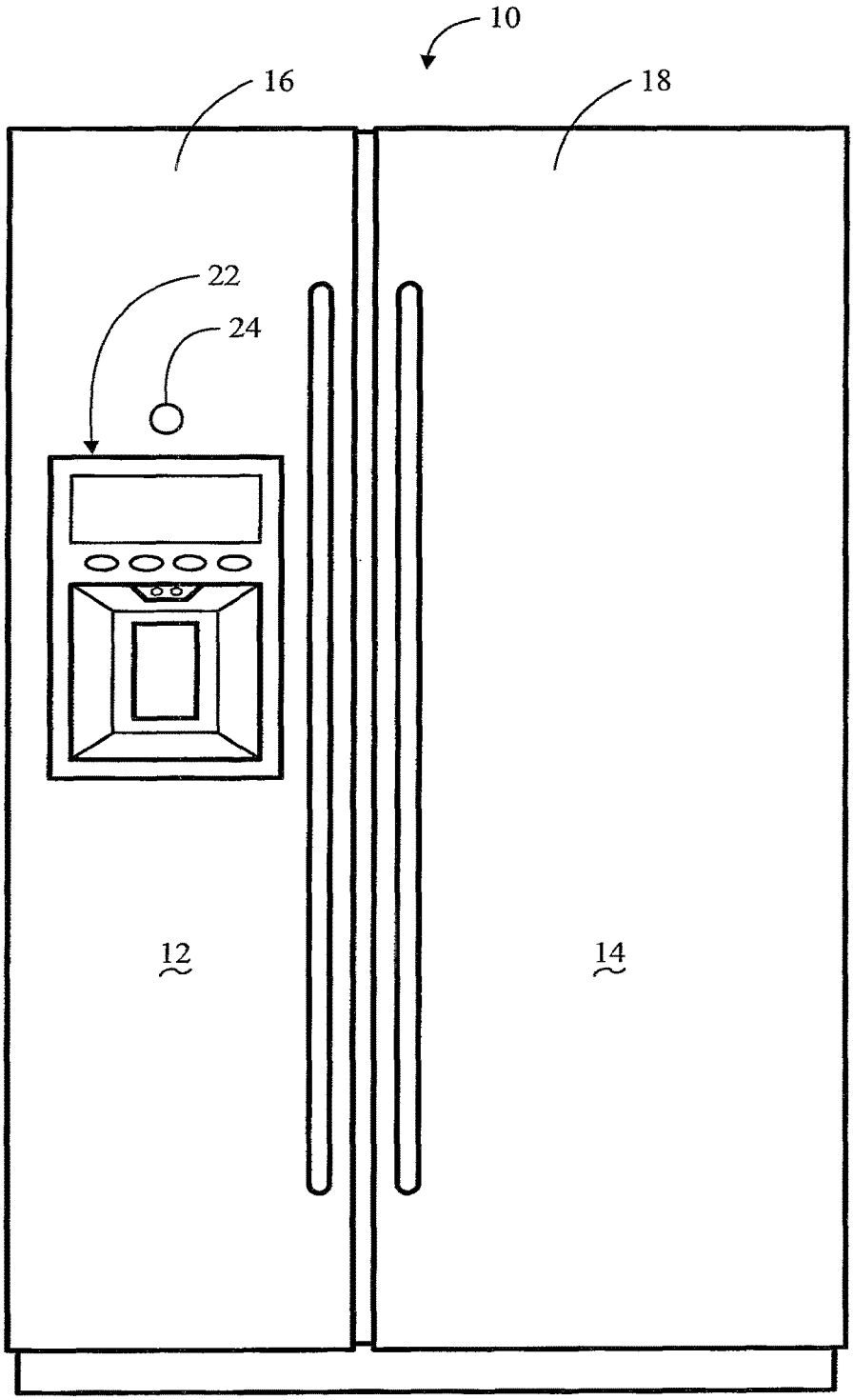
FIG. 1 illustrates one embodiment of a beverage dispensing system and image sensor, in this instance the beverage dispensing system and image sensor are integrated within a refrigerator.

FIG. 1 illustrates a refrigerator 10 having a fresh food compartment 14 and a freezer compartment 12. The fresh food compartment 14 has a door 18 and the freezer compartment 12 has a door 16. The refrigerator 10 includes a beverage dispensing system 22 which is shown in the door 16. The refrigerator 10 also includes an image sensor 24 which is shown in the door 16 and above the beverage dispensing system 22, although the image sensor may be otherwise positioned. The image sensor 24 is used to assist in acquiring images for use in user recognition, image recognition or other functions. As shown in FIG. 1, the refrigerator 10 is shown in a side-by-side configuration. Of course, the refrigerator 10 may take on other configurations as well, such as a bottom mount freezer configuration.

Figure 2:
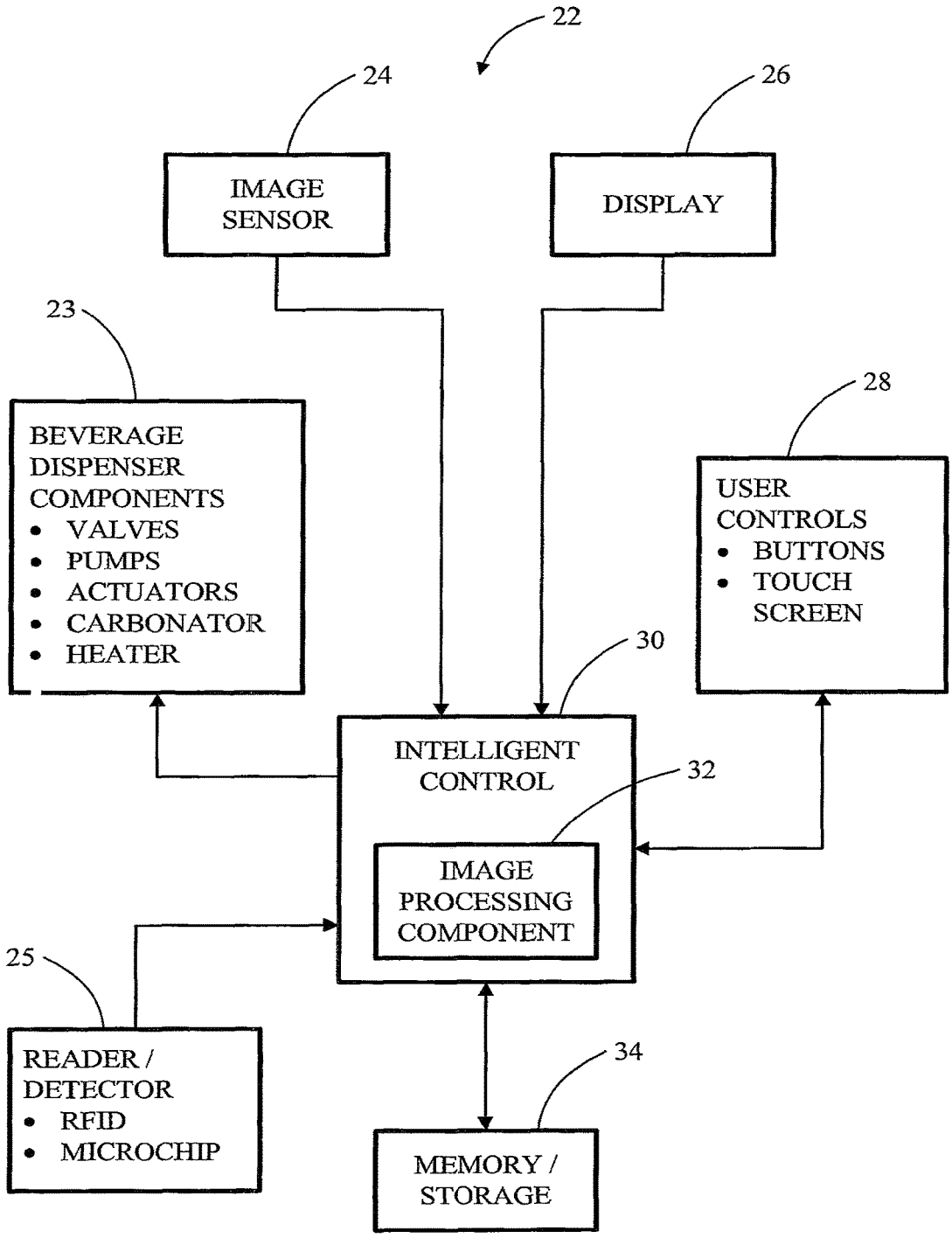
FIG. 2 illustrates a block diagram representation of a user recognition system for a beverage dispensing system.

FIG. 2 illustrates a block diagram representation of a beverage dispensing system 22. The beverage dispensing system 22 may include beverage dispenser components 23. The beverage dispenser components 23 may include actuators, valves, pumps and nozzles to allow the chosen beverage (colas, sparkling water, iced tea, lemonade, fruit punch, hot chocolate, hot tea, coffee, milk, water, hot water, etc) to dispense into a consumer's chosen container (cup, glass, mug, etc). The beverage dispensing system 22 may also dispense ice cubes and or crushed ices.

Another component of the beverage dispensing system 22 is an image sensor 24 which is shown in the door 16 and above the beverage dispensing system 22 (refer to FIG. 1). The image sensor may be a device that converts an optical image to an electric signal. The image sensor 24 may be a charge-coupled device (CCD) or a complementary metal-oxide semiconductor (CMOS) active-pixel sensor, or other type of image sensor or camera.

Another component of the beverage dispensing system 22 is a display 26. The display 26 may display images or symbols which represent the state of the refrigerator, such as fresh food temperature, freezer temperature, beverage dispenser functions and recognition of the present user. The display 26 may be a liquid crystal display (LCD), an organic electro luminescent device (OLED), a quantum-dot-based LED (QDLED), a interferometric modulator display (iMoD), surface-conduction electron-emitter display (SED), or a field emission display (FED). Of course, the image display 26 may use other display technology as well. The display 26 may also be a touch screen.

Another component of the beverage dispensing system 22 are user controls 28. The user controls 28 may include controls such as buttons, touch screen display inputs, sliders or switches, which enable a user to select a preferred dispensing operation or selected other settings.

Another component of the beverage dispensing system 22 is a memory/storage device 34. The memory/storage 34 device may be used to store individual user information and beverage usage patterns. The beverage usage patterns may be daily, weekly, monthly, yearly or for any other period of time. The memory/storage 34 device may be a magnetic memory or a form of semiconductor storage. Of course, the memory/storage device 34 may use other technology as well.

Another component of the beverage dispensing system 22 is reader I detector 25. The reader I detector 25 may be a radio-frequency identification (RFID) system. Radio-frequency identification (RFID) tag may be affixed to the user's beverage container or a microchip may be embedded within the user's beverage container for the purpose of identifying a particular beverage container. As will be discussed later herein the beverage container may be associated with a particular user or type of beverage.

Another component of the beverage dispensing system 22 is an image processing component 32. The image processing component 32 resides within the intelligent controller 30 and processes the electrical signal from the image sensor 24. The image processing component 32 may be implemented in hardware or software or a combination thereof. Where the image processing component 32 is implemented in hardware a dedicated chipset may be used.

Another component of the beverage dispensing system 22 is an intelligent control 30. The intelligent control 30 may function as a main controller. The intelligent control 30 sets the states and controls various refrigerator 10 functions based on those states, including states associated with the fresh food compartment 14, freezer compartment 12, and beverage dispenser components 23. The intelligent control 30 may be a microcontroller, microprocessor, or other type of intelligent control. The intelligent control 30 is electrically connected to the beverage dispenser components 23, and the image sensor 24, the display 26, the user controls 28, the reader/detector 25 and the memory/storage device 34.

Figure 3:
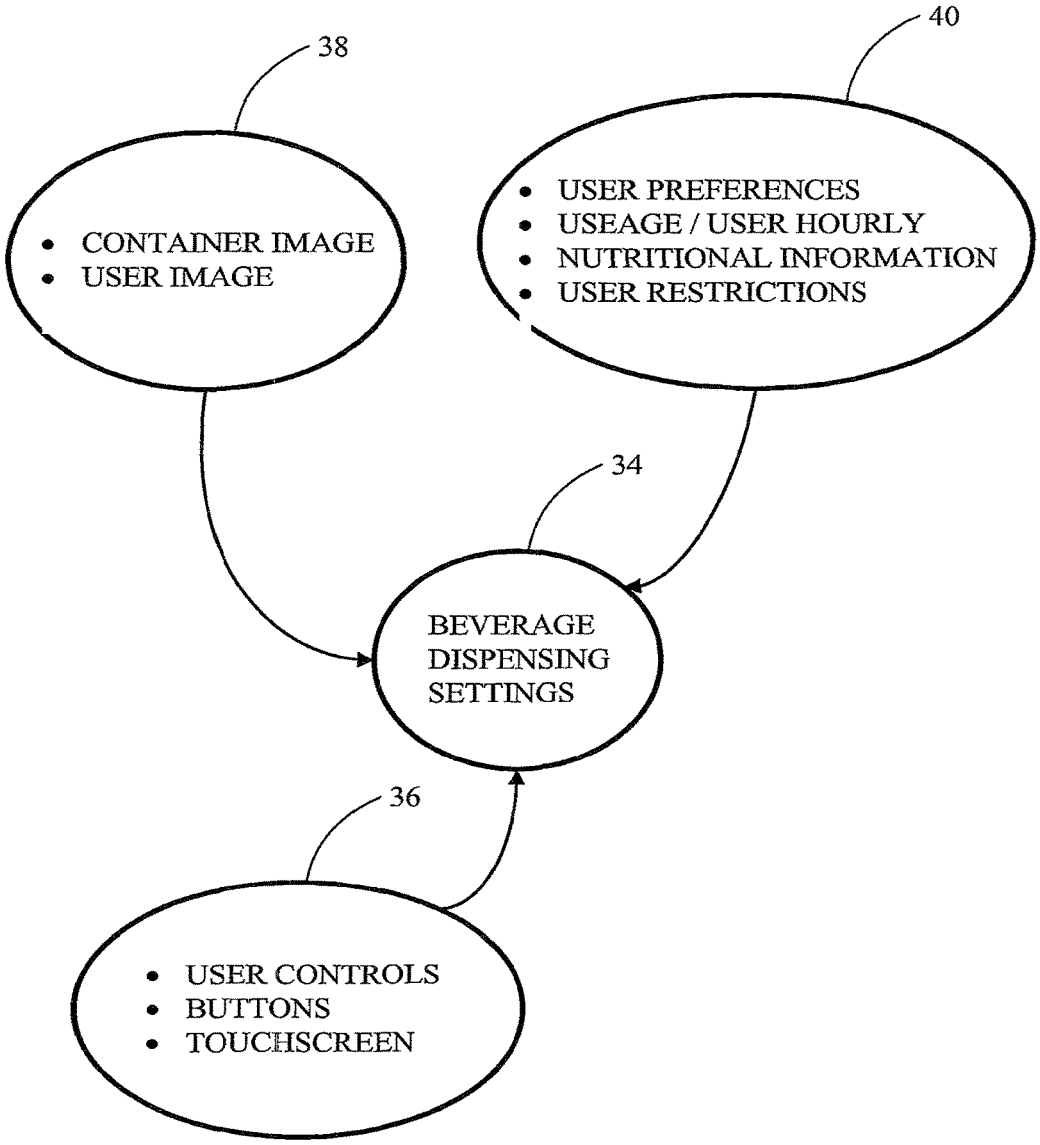
FIG. 3 illustrates a flow diagram representation of the various input parameters for a beverage dispensing system settings.

FIG. 3 illustrates a flow diagram of the various input parameters for the beverage dispensing settings 34 to provide a safe and optimized user experience of the beverage dispenser system 22. The image database 38 which is read and written to the memory/storage 34 contains a container image file and user image file. Each of the image files are obtained via the image sensor 24 and processed within the intelligent control 30 via the image processing component 32. The preference database 40 which may be read and written to the memory/storage 34 contains user preferences, user usage patterns (hourly, daily, monthly, etc.), nutritional information for each beverage and user restrictions. The user interface 36 contains user controls such as buttons and/or a touch screen.

A user may setup a configuration to associate their image, a plurality of container images and a plurality of preferences via the user controls 28. The intelligent control 30 may display user preference queries via the display 26 for the user to respond to. The intelligent control 30 may request the user to enter their name, any restrictions and any beverage preferences which are time dependent, such as coffee in the morning. The intelligent control 30 may request the user to stand still for their image and/or any preferred containers image to be acquired by the image sensor 24. Alternatively, to aid in the setup, the beverage dispensing system 22 may monitor and record use over a period of time. The data from that monitoring process may be used to assist in setting up preferences. The preferences may be parental overrides and child restrictions. Also, the preferences may be patterns of usage such as, coffee or orange juice in the morning. The beverage dispensing system 22 may identify patterns of usage such as, coffee or orange juice in the morning.

Example 1

The beverage dispensing system 22 may de-activate the hot water from dispensing when children are using the beverage dispenser components 23. Thus in this example, the beverage dispensing system 22 provides a safe and optimized usage experience of the beverage dispenser components 23 which may prevent a child from being burned or scalded by the hot water. To do so, the image sensor 24 may acquire an image of the user and determine that the user is a child. One way of doing so is to compare an image of the user with images within a database to determine a match and to then access data associated within the image indicating that the user is a child.

Example 2

The beverage dispensing system 22 may programmed to prevent children from drinking too much of a specific type of beverage. Thus in this example, the beverage dispensing system 22 may limit a child to four caffeinated drinks per day, or no more than one caffeinated drink per hour. Additionally the beverage dispensing system may not allow the child to have caffeinated beverages after a certain hour. The beverage dispensing system 22 may then prevent a child from over indulging in a beverage which may cause them to become over caffeinated and they are therefore provided a safe and optimized beverage dispensing usage experience. To do so, the image sensor 24 may acquire an image of the user and determine that the user is a child. One way of doing so is to compare an image of the user with images within a database to determine a match and to then access data associated within the image indicating that the user is a child.

Example 3

The beverage dispensing system 22 may prepare a given drink that the consumer uses on a regular basis. Thus in this example, the beverage dispensing system 22 may provide coffee or juice in the morning, cola throughout the day. The user places their beverage container into the beverage dispenser components 23 and receives their preferred beverage without the need to make any decisions and they are therefore provided a safe and optimized beverage dispensing usage experience. To do so, the image sensor 24 may acquire an image of the user and determine the identity of that the user. One way of doing so is to compare an image of the user with images within a database to determine a match and to then access data associated within the image indicating that specific user.

Example 4

The beverage dispensing system 22 may recognize a type of container, such as a mug or a specific glass. Thus in this example, the beverage dispensing system 22 may recommend via the user interface a beverage that matches the container type or automatically dispense a beverage that matched the container type. To do so, the image sensor 24 may acquire an image of the container and determine the type of container. One way of doing so is to compare an image of the container with images within a database to determine a match and to then access data associated within the image indicating that specific container type. The user may then place their beverage container into the beverage dispenser components 23 and receive their preferred beverage and they are therefore provided a safe and optimized beverage dispensing usage experience.

Example 5

The beverage dispensing system 22 may display branded logos. Thus in this example, the beverage dispensing system 22 may utilize brandable logos for the user to make their beverage dispensing decisions. To do so, the image sensor 24 may acquire an image of the user and determine the users preferred beverages and then display a plurality of branded logos. One way of doing so is to compare an image of the user with images within a database to determine a match and to then access data associated within the image indicating that user. The user may then place their beverage container into the beverage dispenser components 23 and receive their chosen beverage and they are therefore provided a safe and optimized beverage dispensing usage experience.

Example 6

The beverage dispensing system 22 may display the status of the beverage dispensing system 22. Thus in this example, the beverage dispensing system 22 gives the user important information graphically, iconically and/or textually to the real-time operation of the system via the display 26. The information may include the plurality of beverage dispenser components 23, the image sensor 24, the reader/detector 25, etc. Also, the beverage dispensing system 22 may presently be brewing a beverage, or carbonating a beverage, etc. As these processes occur internally they are not visible to the user, the beverage dispensing system 22 may inform to its state via the display 26. The beverage dispensing system 22 may also notify the user of the need to replace a beverage which is now empty or its expiration date has expired. To do so, the intelligent control 30 may query and acquire the status of the various beverage dispenser components 23, the image sensor, the display 26, the user controls 28 the memory/storage 34, the reader/detector 25 and the image processing component 32. One way of doing so is to compare the existing status of the various beverage dispenser components 23, the image sensor, the display 26, the user controls 28 the memory/storage 34, the reader/detector 25 or the image processing component 32 with the present status of the various beverage dispenser components 23, the image sensor, the user controls 28 the memory/storage 34, the reader/detector 25 and the image processing component 32 within a database to determine a change and to then to indicate that to the user via the display 26.

Example 7

The beverage dispensing system 22 may also display drink information for each user for a given period of time. Thus in this example, the beverage dispensing system 22 gives the user important information such as nutritional or the total volume consumed for each beverage which they may use to adjust their consumption rates. The information may also be used to evaluate costs associated with each beverage over time.

Example 8

The beverage dispensing system 22 may detect a user's container utilizing RFID tags. Thus in this example, the beverage dispensing system 22 recognizes the user based upon the container. To do so, the RFID reader/detector 25 may acquire the identifying information of the container from the RFID tag affixed to the container. One way of doing so is to compare the identifying information located in the RFID tag of the container with identifying information within a database to determine a match and to then access data associated within the identifying information indicating that the user. The system may associate a specific beverage based on the container. The system may also associate the container to a specific user and their beverage preferences. The user then places their beverage container into the beverage dispenser components 23 and is then provided a safe and optimized beverage dispensing usage experience.

Example 9

The beverage dispensing system 22 may detect a user's container utilizing direct contact data communication via a microchip within the container, or other means. Thus in this example, the beverage dispensing system 22 recognizes the user based upon the container. To do so, the RFID reader/detector 25 may acquire the identifying information of the container from the microchip embedded within the container. One way of doing so is to compare the identifying information located in the microchip of the container with identifying information within a database to determine a match and to then access data associated within the identifying information indicating the user. The system may associate a specific beverage based on the container. The system may also associate the container to a specific user and their beverage preferences. The user then places their beverage container into the beverage dispenser components 23 and is then provided a safe and optimized beverage dispensing usage experience.

Example 10

The beverage dispensing system 22 recognizes the container and not the user. Thus in this example, the beverage dispensing system 22 recognizes the container visually as opposed to utilizing a RFID tag affixed to the container or a microchip embedded into the container. The system may associate a specific beverage based on the container. The system may also associate the container to a specific user and their beverage preferences. Thus in this example, the beverage dispensing system 22 may recommend via the user interface a beverage that matches the container type. To do so, the image sensor 24 may acquire an image of the container and determine the type of container. One way of doing so is to compare an image of the container with images within a database to determine a match and to then access data associated within the image indicating that specific container type. The user may then place their beverage container into the beverage dispenser components 23 and receive their preferred beverage and they are therefore provided a safe and optimized beverage dispensing usage experience. The user then places their beverage container into the beverage dispenser components 23 and is then provided a safe and optimized beverage dispensing usage experience.

Example 11

The beverage dispensing system 22 may limit caloric intake of the user for a given period of time. Thus in this example, the beverage dispensing system 22 prevents the user from dispensing any beverage once a caloric limit has been reached for the given period of time. To do so, the image sensor 24 may acquire an image of the container and/or the user and determine the type of container and/or the user. One way of doing so is to compare an image of the container and/or the user with images within a database to determine a match and to then access data associated within the image indicating that specific container type and/or the user. The beverage dispensing system 22 may query the user regarding limiting caloric intake or the user may initiate limiting caloric intake via the user interface 36. The user may limit their caloric intake to 1000 calories a day or any other caloric value or time period. The user may then place their beverage container into the beverage dispenser components 23 and receive their preferred beverage and they are therefore provided a safe and optimized beverage dispensing usage experience.

Example 12

The beverage dispensing system 22 may limit drink selections of the user. Thus in this example, the beverage dispensing system 22 prevents the user from dispensing certain beverages, such as sugary or caffeinated beverages, etc. To do so, the image sensor 24 may acquire an image of the container and/or the user and determine the type of container and/or the user. One way of doing so is to compare an image of the container and/or the user with images within a database to determine a match and to then access data associated within the image indicating that specific container type and/or the user. The beverage dispensing system 22 may query the user regarding limiting caloric intake or the user may initiate limiting caloric intake via the user interface 36. The user may limit their caloric intake to 1000 calories a day or any other caloric value or time period. The user may then place their beverage container into the beverage dispenser components 23 and receive their preferred beverage and they are therefore provided a safe and optimized beverage dispensing usage experience.

Example 13

The beverage dispensing system 22 may inform the user of their beverage usage. Thus in this example, the beverage dispensing system 22 informs the user of their beverage usage via the display 26 for monitoring dietary intake. The information may include total beverages, total volume and total calories for a day, a week, a month or any length of time. The beverage dispensing system 22 may query the user regarding displaying the information or the information may be displayed as a normal operating function of the beverage dispensing system 22. To do so, the image sensor 24 may acquire an image of the user and determine the user. One way of doing so is to compare an image of the user with images within a database to determine a match and to then access data associated within the image indicating the user and then displaying the beverage usage.

Example 14

The beverage dispensing system 22 may inform the user of their beverage usage. Thus in this example, the beverage dispensing system 22 informs the user of their beverage usage via the display 26 to assist with inventory management. The information may include total beverage usage for a day, a week, a month or any length of time. The beverage dispensing system 22 may query the user regarding displaying the information or the information may be displayed as a normal operating function of the beverage dispensing system 22. To do so, the image sensor 24 may acquire an image of the user and determine the user. One way of doing so is to compare an image of the user with images within a database to determine a match and to then access data associated within the image indicating the user and then displaying the beverage inventory levels.

Example 15

The beverage dispensing system 22 recognizes indicia on the container. Thus in this example, the beverage dispensing system 22 may recommend via the user interface a beverage that matches the container indicia or automatically dispense a beverage that matched the container indicia. To do so, the image sensor 24 may acquire an image of the container indicia and determine the indicia on the container. One way of doing so is to compare an image of the container indicia with images within a database to determine a match and to then access data associated within the image indicating that specific container indicia. The user may then place their beverage container into the beverage dispenser components 23 and receive their preferred beverage and they are therefore provided a safe and optimized beverage dispensing usage experience.

The invention has been shown and described above with the preferred embodiments, and it is understood that many modifications, substitutions, and additions may be made which are within the intended spirit and scope of the invention. The present invention is not to be limited to any specific embodiment described herein.

What is claimed is:

1. A beverage dispensing system comprising:

a refrigerator having a refrigerator cabinet with a fresh food compartment disposed within the refrigerator cabinet;

a beverage dispenser operatively connected to the refrigerator cabinet and configured to dispense beverages; an image acquiring device that captures an image of a user and captures a beverage container image; an intelligent control chosen from the group consisting of a microcontroller and a microprocessor;

a memory device that stores the image of the user and the beverage container image in communication with the intelligent control; and wherein the intelligent control is operatively connected to the beverage dispenser and the image acquiring device and wherein the intelligent control; associates the image of the user, the beverage container image, and user preferences with the user; requests a user parameter; and receives the user parameter in response to the request; and wherein the user parameter is used for recommendation of modifying beverage dispensing or modification of dispensed beverages based on the acquired image of the user.

2. The beverage dispensing system of claim 1, wherein the intelligent control determines an identity of the user of the beverage dispensing system based upon image information acquired with the image acquiring device and the image of the user.

3. The beverage dispensing system of claim 2, wherein the beverage dispenser adjusts beverage parameters based on the identity of the user.

4. The beverage dispensing system of claim 1, wherein the image acquiring device is an image sensor that is on a surface of the refrigerator; the intelligent control is electrically connected to the beverage dispensing system and the image sensor; and the beverage dispensing system is configured to disable dispensing of one or more beverages based on the identity of the user.

5. The beverage dispensing system of claim 4, wherein the beverage dispenser is configured to adjust beverage parameters at least partially based on image information acquired with the image sensor and the image sensor is positioned on a front surface of the refrigerator.

6. The beverage dispensing system of claim 5, wherein the image information is associated with a beverage container of the user.

7. The beverage dispensing system of claim 5, wherein the image information is associated with the user.

8. The beverage dispensing system of claim 5, wherein the beverage dispenser is configured to adjust beverage parameters at least partially based on time of day.

9. The beverage dispensing system of claim 1, wherein the intelligent control is configured for storing usage data for the beverage dispensing system where the usage data is beverage usage patterns over a period of time; and wherein the intelligent control requests user parameter directly from the user.

10. The beverage dispensing system of claim 9, wherein the usage data further includes beverage type data.

11. The beverage dispensing system of claim 10, wherein the usage data further includes user data.

12. A beverage dispensing system comprising:

a refrigerator having a refrigerator cabinet with a fresh food compartment disposed within the refrigerator cabinet;

a beverage dispenser operatively connected to the refrigerator cabinet and configured to dispense beverages;

an image acquiring device that captures an image of a user and captures an image of a beverage container;

an intelligent control configured to control the operations of the beverage dispensing system;

a memory device that stores the image of the user and the image of the beverage container in communication with the intelligent control, and stores user information input regarding the user and provided by the user in response to user prompts by the intelligent control; and wherein the intelligent control is operatively connected to the beverage dispenser and the image acquiring device and wherein the intelligent control associates the image of the user, the beverage container image, and user preferences with the user, and requests user input directly from the user and receives user input in response to the requests, wherein user input, as well as other user parameters not input by the user, is used for modifying or recommendations for modifying beverage dispensing.

13. The beverage dispensing system of claim 12, wherein the intelligent control uses the image acquiring device to identify whether the user is a child.

14. The beverage dispensing system of claim 13, wherein the intelligent control deactivates the heating of liquid in response to the user being identified as a child.

15. The beverage dispensing system of claim 12, wherein the intelligent control prevents dispensing of too much of a particular beverage by an individual.

16. The beverage system of claim 12, wherein the intelligent control provides different times of day for dispensing different beverages.

17. The beverage system of claim 12, wherein the intelligent control offers different types of beverages based on different containers being identified.

18. The beverage container of claim 12, wherein the intelligent control offers different beverages in response to a user consuming more than a specified amount of a beverage within a specified period of time.

19. A beverage dispensing system comprising:

a refrigerator having a refrigerator cabinet with a fresh food compartment disposed within the refrigerator cabinet;

a beverage dispenser operatively connected to the refrigerator cabinet and configured to dispense beverages;

an image acquiring device that captures an image of a user and captures an image of a beverage container;

an intelligent control configured to control the operations of the beverage dispensing system;

a memory device that stores the image of the user and the image of the beverage container in communication with the intelligent control, and stores user information input regarding the user and provided by the user in response to user prompts by the intelligent control; and wherein the intelligent control is operatively connected to the beverage dispenser and the image acquiring device and wherein the intelligent control; associates the image of the user, the beverage container image, and user preferences with the user; requests a user parameter; and receives the user parameter in response to the requests; wherein the user parameter is used for modifying beverage dispensing or for recommendations for modifying beverage dispensing; and wherein the intelligent control advises the user of total volume consumed for each beverage over a specified period of time with a recommendation to adjust their consumption rates.

* * * * *